United States Patent [19]

Havel

[11] Patent Number: 4,734,619

[45] Date of Patent: Mar. 29, 1988

[54] DISPLAY DEVICE WITH VARIABLE COLOR BACKGROUND

[76] Inventor: Karel Havel, P.O. Box 66, Station M, Toronto, Ontario, Canada, M6S 4T2

[21] Appl. No.: 882,430

[22] Filed: Jul. 7, 1986

[51] Int. Cl.[4] ..... G09G 3/14; G09G 3/04; G08B 5/36

[52] U.S. Cl. ..... 313/510; 313/498; 313/499; 313/513; 313/116; 340/701; 340/703; 340/762; 340/782; 340/815.1; 315/169.3

[58] Field of Search ..... 340/701, 703, 782, 815.1, 340/715, 762; 315/169.3, 169.2, 169.1; 313/499, 513, 500, 501, 507; 40/444, 451, 581

[56] References Cited

U.S. PATENT DOCUMENTS

| | | | |
|---|---|---|---|
| 3,595,991 | 7/1971 | Diller | 315/169.3 X |
| 3,911,418 | 10/1975 | Takeda | 340/703 |
| 4,086,514 | 4/1978 | Havel | 313/500 |
| 4,271,408 | 6/1981 | Teshima et al. | 340/702 |
| 4,301,450 | 11/1981 | Smoliar | 340/715 |
| 4,488,149 | 12/1984 | Givens, Jr. | 340/762 |
| 4,581,612 | 4/1986 | Jones | 340/715 X |

*Primary Examiner*—David K. Moore
*Assistant Examiner*—Mark R. Powell

[57] ABSTRACT

A variable color display device includes a plurality of variable color display areas arranged in a pattern and substantially surrounded by a variable color background area. The color of the background area is controlled to be substantially complementary to the color of the display areas to make the exhibited character clearly stand out against its background.

5 Claims, 6 Drawing Figures

DISPLAY DEVICE WITH VARIABLE COLOR BACKGROUND

BACKGROUND OF THE INVENTION

1. Field of the Invention

This invention relates to variable color display devices.

2. Description of the Prior Art

A display device that can change color and selectively exhibit characters is described in my U.S. Pat. No. 4,086,514 entitled Variable Color Display Device and issued on Apr. 25, 1978. This display device includes display areas arranged in a suitable display font, such as well known 7-segment font, which may be selectively energized in groups to exhibit all known characters. Each display area includes three light emitting diodes for emitting light signals of respectively different primary colors which are blended within the display area to form a composite light signal. The color of the composite light signal can be controlled by varying the portions of the primary light signals.

The capability of a variable color display device to vary the color of its display areas over the entire spectrum has a drawback in that certain colors of the display areas may be similar to the color of the display background, thereby rendering the exhibited character difficult to recognize, particularly in imperfect viewing conditions. From an aesthetic aspect, small color differences between the display and background areas are likely to be displeasing and give an impression of instability.

SUMMARY OF THE INVENTION

Accordingly, it is the principal object of this invention to provide an improved variable color display device capable of illuminating its display areas in substantially any color of the spectrum and its background area in a complementary color for providing better recognition of exhibited characters.

It is another object of the invention to provide a variable color display device that exhibits characters in an aesthetically pleasing and harmonious manner.

In summary, variable color display device of this invention includes a plurality of variable color display segments arranged in a pattern and surrounded by a variable color background area. The displayed character may be illuminated in a desired color, and its background area may be illuminated in a color substantially complementary to more effectively exhibit the character.

Further objects of the invention will become obvious from the accompanying drawings and their description.

BRIEF DESCRIPTION OF THE DRAWINGS

In the drawings in which is shown the preferred embodiment of the invention.

Throughout the drawings, like characters indicate like parts.

DESCRIPTION OF THE PREFERRED EMBODIMENT

Figure 1A:
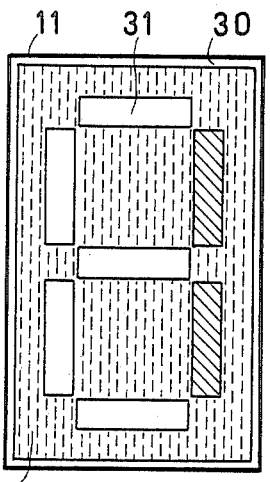
FIG. 1*a* is a plan view of a variable color display device of the present invention on which numeral '1' is illuminated in green color on purple background.
Figure 1B:
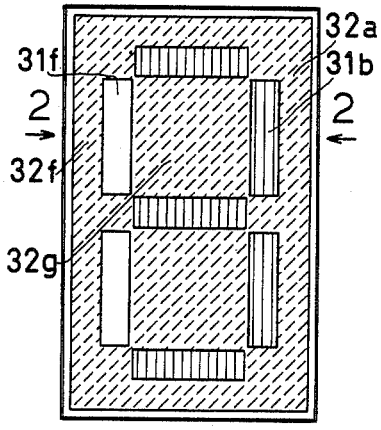
FIG. 1*b* is a similar view of a variable color display device on which numeral '3' is illuminated in red color on blue-green background.
Figure 1C:
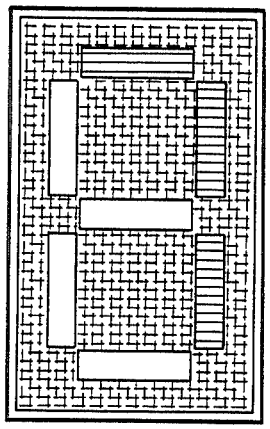
FIG. 1*c* is a similar view of a variable color display device on which numeral '7' is illuminated in blue color on yellow background.

Referring now, more particularly, to the drawings, in FIG. 1*a* is shown a variable color display device 11 of the present invention accommodated in a housing 30 and including a variable color display area consisting of seven segments 31 arranged in a well known 7-segment font on which digits and selected characters may be exhibited in variable color. The invention resides in the addition of a variable color background area 32, substantially surrounding the display area, which may be illuminated in a color definitely different from, and preferably complementary to, the color of the display area to exhibit the characters more effectively. It will be recalled that complementary colors are colors that produce a neutral color when additively mixed in suitable proportions. Generally, red colors are complementary to blue-green colors, green colors are complementary to purple colors, and blue colors are complementary to yellow colors. By referring to several illustrated examples, in FIG. 1*a* is shown numeral '1' illuminated in green color on purple background, in FIG. 1*b* is shown numeral '3' illuminated in red color on blue-green background, and in FIG. 1*c* is shown numeral '7' illuminated in blue color on yellow background. It is readily apparent that the maximum color contrast between the display and background areas facilitates recognition of displayed characters and is aesthetically pleasing and harmonious.

Figure 2:
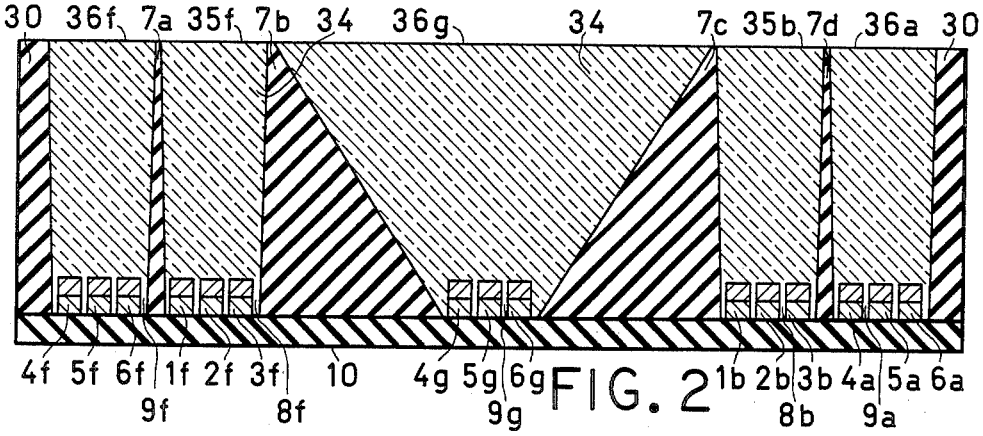
FIG. 2 is a cross-sectional view, taken along the line 2—2 in FIG. 1*b*, revealing internal structure of a variable color display device.

As will be revealed more clearly subsequently, each display segment and background region includes a triad of light emitting diodes (LEDs) adapted for emitting light signals of respectively different primary colors. An important consideration has been given to physical arrangement of the light emitting diodes in the display and background areas, as illustrated in FIG. 2. In the display segment 31*f*, red LED 1*f*, green LED 2*f*, and blue LED 3*f* are disposed on a support 10 in a display light blending cavity 8*f* and completely surrounded by transparent light scattering material 34. When forwardly biased, the LEDs 1*f*, 2*f*, and 3*f* emit light signals of red, green, and blue colors, respectively, which are blended by passing through light scattering material 34, acting to disperse the light signals, to form a composite light signal that emerges at the upper surface 35*f* of the display segment 31*f*. The color of the composite light signal may be controlled by varying the portions of red, green, and blue light signals. In the display segment 31*b*, the red LED 1*b*, green LED 2*b*, and blue LED 3*b* are similarly disposed in a display light blending cavity 8*b* and may be similarly activated.

In a similar fashion, red LED 4*g*, green LED 5*g*, and blue LED 6*g* in the background region 32*g* are disposed on the support 10 in a background light blending cavity 9*g* and surrounded by transparent light scattering material 34. When forwardly biased, the LEDs 4*g*, 5*g*, and 6*g* emit light signals of red, green, and blue colors, respectively, which are blended by passing through the light scattering material 34 to form a composite light signal of a composite color that emerges at the upper surface 36*g* of the background region 32*g*. In the background region 32*f*, the red LED 4*f*, green LED 5*f*, and blue LED 6*f* are similarly disposed in a background light blending cavity and may be similarly activated. The red LED 4*a*, green LED 5*a*, and blue LED 6*a* in the background region 32*a*, disposed in a background light blending cavity 9*a*, may be activated in a similar fashion.

The display segments are optically separated from adjacent background regions by opaque walls. In the display segment 31*f*, the walls 7*a* and 7*b* have generally smooth inclined surfaces defining an obtuse angle with the support 10 and defining a display light blending cavity 8*f* therebetween. Alternatively, the wall surfaces may be rough to further promote diffusion of the light signals. In the background region 32*g*, the inclined walls 7*b* and 7*c* similarly define a background light blending cavity 9*g* therebetween. In a similar fashion, the display light blending cavity 8*b* is defined by the walls 7*c* and 7*d*, background light blending cavity 9*a* is defined by the wall 7*d* and housing 30, and background light blending cavity 9*f* is defined by housing 30 and wall 7*a*. The width of the top surfaces of the opaque walls is uniform and distinctly less than the width of the display segments or the background regions so as to minimize the boundaries therebetween. The top surfaces of the opaque walls, top surfaces of the display segments, and top surfaces of the background regions are in the same plane to allow wide angle observation of the display device. Although the walls and light blending cavities are shown to be of certain shapes and dimensions, it is envisioned that they may be modified and rearranged.

Figure 3:
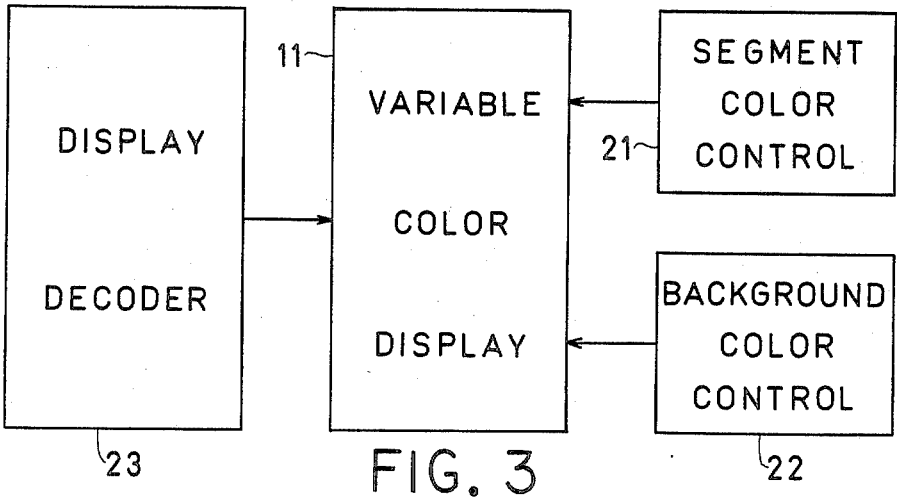
FIG. 3 is a block diagram showing the activation of a variable color display device.

In FIG. 3 is shown a block diagram of a variable color display system of the invention which includes a variable color display device 11, display decoder 23 for converting input codes to displayable codes for displaying a desired character by activating appropriate groups of display segments, segment color control 21 for illuminating the display segments in a desired color, and background color control 22 for illuminating the background area in a color definitely different from the color of the display segments. The segment color control and background color control may be independent, as illustrated, or background color may be derived from the segment color, as will be pointed out subsequently.

Figure 4:
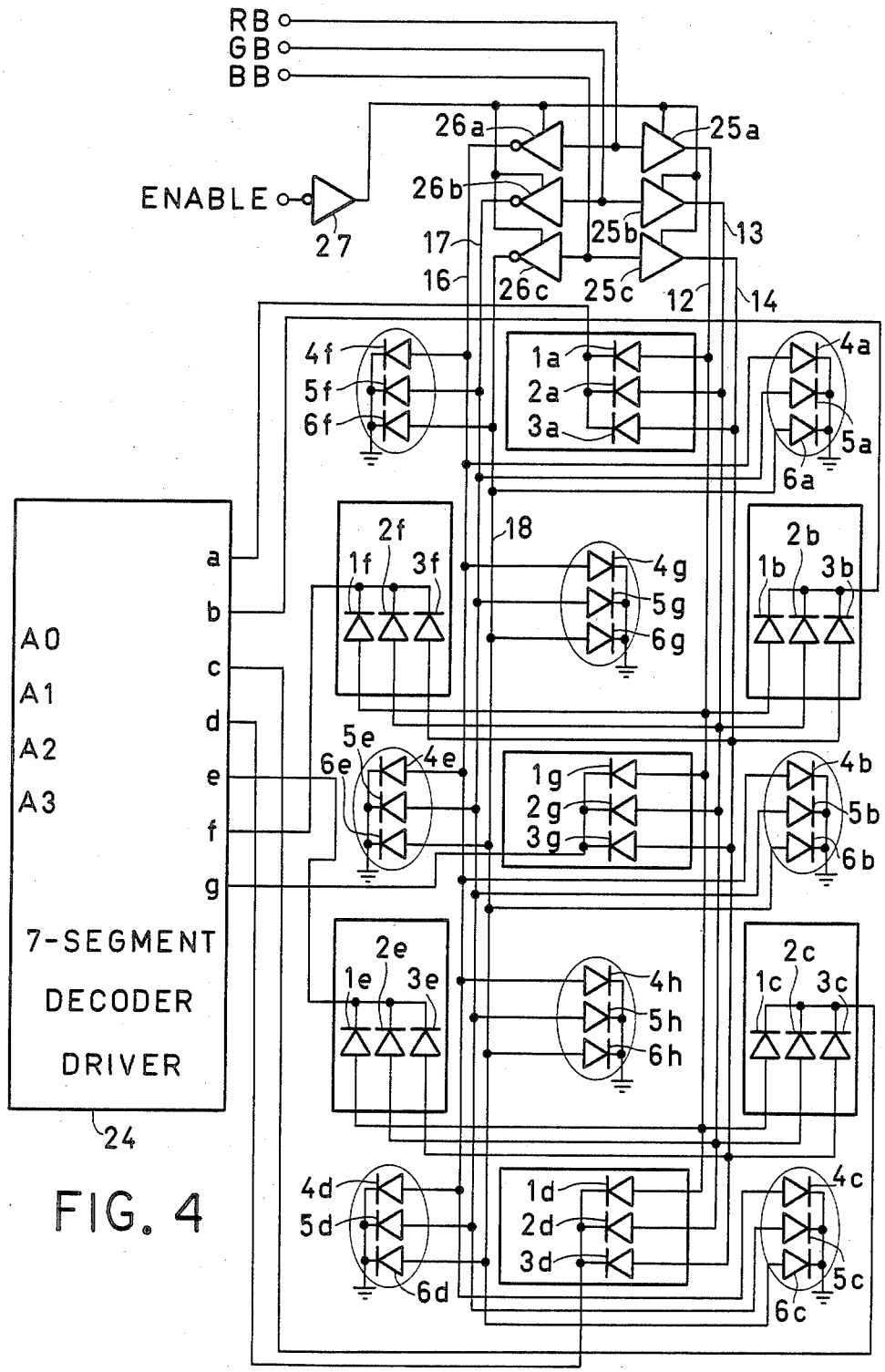
FIG. 4 is a simplified schematic diagram of a variable color display device.

Proceeding now to the detailed description, in FIG. 4 is shown a simplified schematic diagram of a one-character 7-segment variable color display element with variable color background of the invention. The circuit employs a common anode 7-segment decoder driver which may be substantially conventional with the qualification that it must be capable of driving a triad of LEDs in each display segment rather than a single LED.

Each display segment of the display device 11 includes a triad of closely adjacent LEDs: a red LED 1, green LED 2, and blue LED 3 which are adapted for producing a composite light signal of a variable color. To facilitate the illustration, the LEDs are designated by segment letters, e.g., red LED in the segment b is shown at 1*b*, green LED in the segment d is shown at 2*d*, and blue LED in the segment f is shown at 3*f*. The background area is comprised of background regions adjacent the display segments but alternatively may be integral. Each background region includes a triad of closely adjacent LEDs: a red LED 4, green LED 5, and blue LED 6 which are adapted for producing a composite light signal of a variable color. As much as possible, the background regions are designated by letters of adjacent display segments.

The cathodes of all red, green, and blue LED triads are interconnected in each display segment and electrically coupled to respective outputs of the decoder 24. The anodes of all display red LEDs 1*a*, 1*b*, 1*c*, 1*d*, 1*e*, 1*f*, and 1*g* are interconnected to form a common electric path referred to as a display red bus 12. The anodes of all display green LEDs 2*a*, 2*b*, 2*c*, 2*d*, 2*e*, 2*f*, and 2*g* are interconnected to form a like common electric path referred to as a display green bus 13. The anodes of all display blue LEDs 3*a*, 3*b*, 3*c*, 3*d*, 3*e*, 3*f*, and 3*g* are interconnected to form a like common electric path referred to as a display blue bus 14.

In a similar fashion, the anodes of all background red LEDs 4*a*, 4*b*, 4*c*, 4*d*, 4*e*, 4*f*, 4*g*, and 4*h* are interconnected to form a common electric path referred to as a background red bus 16. The anodes of all background green LEDs 5*a*, 5*b*, 5*c*, 5*d*, 5*e*, 5*f*, 5*g*, and 5*h* are interconnected to form a like common electric path referred to as a background green bus 17. The anodes of all background blue LEDs 6*a*, 6*b*, 6*c*, 6*d*, 6*e*, 6*f*, 6*g*, and 6*h* are interconnected to form a like common electric path referred to as a background blue bus 18. The cathodes of all red, green, and blue LED triads in each background region are grounded.

The display red bus 12 is connected to the output of a non-inverting tri-state buffer 25*a* capable of sourcing sufficient current to illuminate all display red LEDs. The display green bus 13 is connected to the output of a like buffer 25*b*. The display blue bus 14 is connected to the output of a like buffer 25*c*.

The background red bus 16 is connected to the output of an inverting tri-state buffer 26*a* capable of sourcing sufficient current to illuminate all background red LEDs. The background green bus 17 is connected to the output of a like buffer 26*b*. The background blue bus 18 is connected to the output of a like buffer 26*c*.

It would be obvious to those skilled in the art that current limiting resistors should be connected in series with all LEDs in the circuit to constrain current flow. Such resistors are omitted in the interest of clarity.

The six tri-state buffers 25*a*, 25*b*, 25*c*, 26*a*, 26*b*, and 26*c* can be simultaneously enabled, by applying a low logic level signal to the ENABLE input of an inverter 27, and disabled by applying a high logic level signal therein. When the buffers 25*a*, 25*b*, 25*c*, 26*a*, 26*b*, and 26*c* are disabled, all six buses are effectively disconnected, and all display segments and background regions are completely extinguished.

When the buffers are enabled, the color of the display segments may be controlled by applying proper combinations of logic level signals to the bus control inputs RB (red bus), GB (green bus), and BB (blue bus). Since the display segments are driven by non-inverting buffers and background regions by inverting buffers, the display segments illuminate in the selected color, and the background regions illuminate in substantially complementary color.

The operation of the display element shown in FIG. 4 will be now explained on example of illuminating digit '1' in green color. To exhibit decimal number '1', a BCD code 0001 is applied to the inputs A0, A1, A2, A3 of the common anode 7-segment decoder driver 24. The decoder 24 develops low logic levels at its outputs b, c, to illuminate equally designated display segments, and high logic levels at all remaining outputs, to extinguish all remaining display segments.

To illuminate the display element in green color, the bus control input GB is raised to a high logic level, while both remaining bus control inputs RB and BB are maintained at a low logic level. As a result, the output of the buffer 25*b* rises to a high logic level. The current flows from the output of the buffer 25*b*, via display green bus 13 and green LED 2*b*, to the output b of the decoder 24, and, via green LED 2*c*, to the output c of the decoder 24. As a result, the display segments b, c illuminate in green color. Since the bus control inputs RB and BB are at a low logic level, the outputs of inverting buffers 26*a* and 26*c* rise to a high logic level. The current flows from the output of the buffer 26*a* via all red LEDs 4*a* to 4*h* in parallel to ground. The current also flows from the output of the buffer 26*c* via all blue LEDs 6*a* to 6*h* in parallel to ground. As a result of blending the red and blue light signals in each background region, the entire background area illuminates in substantially purple color. The overall effect is numeral '1' illuminated in green color on substantially purple background, as shown in FIG. 1*a*.

To exhibit decimal number '3' in red color, a BCD code 0011 is applied to the inputs A0, A1, A2, A3 of the decoder 24. The decoder 24 develops low logic levels at its outputs a, b, c, d, g, to illuminate equally designated display segments, and high logic levels at all remaining outputs, to extinguish all remaining display segments.

To illuminate the display element in red color, the bus control input RB is reaised to a high logic level, while both remaining bus control inputs GB and BB are maintained at a low logic level. As a result, the output of the buffer 25*a* rises to a high logic level. The current flows from the output of the buffer 25*a*, via display red bus 12 and red LED 1*a* to the output a of the decoder 24, via red LED 1*b* to the output b of the decoder 24, via red LED 1*c* to the output c of the decoder 24, via red LED 1d to the output d of the decoder 24, and via red LED 1*g* to the output g of the decoder 24. As a result, the segments a, b, c, d, g illuminate in red color. Since the bus control inputs GB and BB are at a low logic level, the outputs of inverting buffers 26*b* and 26*c* rise to a high logic level. The current flows from the output of the buffer 26*b* via all green LEDs 5*a* to 5*h* in parallel to ground. The current also flows from the output of the buffer 26*c* via all blue LEDs 6*a* to 6*h* in parallel to ground. As a result of blending the green and blue light signals in each background region, the entire background area illuminates in substantially blue-green color. The overall effect is numeral '3' illuminated in red color on substantially blue-green background, as shown in FIG. 1*b*.

To exhibit decimal number '7' in blue color, a BCD code 0111 is applied to the inputs A0, A1, A2, A3 of the decoder 24. The decoder 24 develops low logic levels at its outputs a, b, c, to illuminate equally designated segments, and high logic levels at all remaining outputs, to extinguish all remaining display segments.

To illuminate the display element in blue color, the bus control input BB is raised to a high logic level, while both remaining bus control inputs RB and GB are maintained at a low logic level. As a result, the output of the buffer 25*c* rises to a high logic level. The current flows from the output of the buffer 25*c*, via display blue bus 14 and blue LED 3*a* to the output a of the decoder 24, via blue LED 3*b* to the output b of the decoder 24, and via blue LED 3*c* to the output c of the decoder 24. As a result, the display segments a, b, c illuminate in blue color. Since the bus control inputs RB and GB are at a low logic level, the outputs of inverting buffers 26*a* and 26*b* rise to a high logic level. The current flows from the output of the buffer 26*a* via all red LEDs 4*a* to 4*h* in parallel to ground. The current also flows from the output of the buffer 26*b* via all green LEDs 5*a* to 5*h* in parallel to ground. As a result of blending the red and green light signals in each background region, the entire background area illuminates in substantially yellow color. The overall effect is numeral '7' illuminated in blue color on substantially yellow background, as shown in FIG. 1*c*.

The invention may be now briefly summarized. The method was disclosed of selectively exhibiting display units in a variable color by causing a display area to be illuminated in a selected color and by causing a background area substantially surrounding the display area to be illuminated in a substantially complementary color to more effectively exhibit the display units.

A variable color display device was disclosed that comprises a plurality of variable color display areas arranged in a pattern and adapted to be illuminated in groups in a selected color to selectively exhibit a plurality of display units and a variable color background area substantially surrounding the display areas and adapted to be illuminated in a color definitely different from the color of the display areas.

All matter herein described and illustrated in the accompanying drawings should be interpreted as illustrative and not in a limiting sense. It would be obvious that numerous modifications can be made in the construction of the preferred embodiment shown herein, without departing from the spirit of the invention as defined in the appended claims.

CORRELATION TABLE

This is a correlation table of reference characters used in the drawings herein, their descriptions, and examples of commercially available parts.

| # | DESCRIPTION | EXAMPLE |
|---|---|---|
| 1 | display red LED | |
| 2 | display green LED | |
| 3 | display blue LED | |
| 4 | background red LED | |
| 5 | background green LED | |
| 6 | background blue LED | |
| 7 | opaque wall | |
| 8 | display light blending cavity | |
| 9 | background light blending cavity | |
| 10 | support | |
| 11 | variable color display device | |
| 12 | display red bus | |
| 13 | display green bus | |
| 14 | display blue bus | |
| 16 | background red bus | |
| 17 | background green bus | |
| 18 | background blue bus | |
| 21 | segment color control | |
| 22 | background color control | |
| 23 | display decoder | |
| 24 | common anode 7-segment decoder driver | 7446 |
| 25 | non-inverting buffer | 74LS244 |
| 26 | inverting buffer | 74LS240 |
| 27 | inverter | part of 74LS240,4 |
| 30 | housing | |
| 31 | display area | |
| 32 | background area | |
| 34 | light scattering material | |
| 35 | top surface of display area | |
| 36 | top surface of background area | |

What I claim is:

1. A variable color display device comprising:

a plurality of variable color display areas arranged in a pattern, each said display area including a plurality of display light sources for emitting upon activation light signals of different colors and means for combining said light signals to obtain a composite light signal of a composite color;

a variable color background area substantially surrounding said display areas and including a plurality of background regions adjacent to said display areas, each said background region including a plurality of light sources for emitting upon activation light signals of different colors and means for combining said light signals to obtain a composite light signal of a composite color;

a plurality of opaque walls for optically separating said background regions from adjacent display areas; and means for selectively activating said display light sources, to illuminate certain of said display areas in a first color, and said background light sources, to illuminate said background regions in a second color different from said first color.

2. A variable color display device comprising:

a plurality of variable color display areas arranged in a pattern, each said display area including three display light emitting diodes for emitting upon activation light signals of respectively different primary colors and means for combining said light signals to obtain a composite light signal of a composite color;

a variable color background area substantially surrounding said display areas and including a plurality of variable color background regions adjacent to said display areas, each said background region including three background light emitting diodes for emitting upon activation light signals of respectively different primary colors and means for combining said light signals to obtain a composite light signal of a composite color;

a plurality of opaque walls for optically separating said background regions from adjacent display areas; and means for selectively activating said display light emitting diodes, to illuminate certain of said display areas in a first color, and said background light emitting diodes, to illuminate said background regions in a second color different from said first color.

3. A variable color display device comprising:

a plurality of variable color display areas arranged in a pattern, each said display area having a top surface of a predetermined width and including three display light emitting diodes for emitting upon activation light signals of respectively different primary colors and means for combining said light signals to obtain a composite light signal of a composite color;

a variable color background area substantially surrounding said display areas and including a plurality of variable color background regions adjacent to said display areas, each said background region having a top surface of a predetermined width and including three background light emitting diodes for emitting upon activation light signals of respectively different primary colors and means for combining said light signals to obtain a composite light signal of a composite color;

a plurality of opaque walls for optically separating said background regions from adjacent display areas, each said wall having a top surface of a width less than the width of the top surface of the adjacent display area or the width of the top surface of the adjacent background region to minimize the boundary therebetween; and means for selectively activating said display light emitting diodes, to illuminate certain of said display areas in a first color, and said background light emitting diodes, to illuminate said background regions in a second color different from said first color.

4. A variable color display device as defined in claim 3 wherein the top surfaces of said display areas, top surfaces of said background regions, and top surfaces of said walls are in substantially same plane to allow wide angle observation of the display device.

5. A variable color display device comprising:

a substantially flat support having a surface;

a plurality of display light blending cavities formed in said surface in a pattern, each said display light blending cavity defining a variable color display area and including three display light emitting diodes for emitting upon activation light signals of respectively different primary colors and means for combining said light signals to obtain a composite light signal of a composite color;

a plurality of background light blending cavities formed in said surface and adjacent to said display light blending cavities, each said background light blending cavity defining a variable color background region and including three background light emitting diodes for emitting upon activation light signals of respectively different primary colors and means for combining said light signals to obtain a composite light signal of a composite color;

a plurality of opaque walls for optically separating said background light blending cavities from adjacent display light blending cavities; and means for selectively activating said display light emitting diodes, to illuminate certain of said display areas in a first color, and said background light emitting diodes, to illuminate said background regions in a second color different from said first color.

* * * * *